US007584930B2

(12) United States Patent
Zich

(10) Patent No.: US 7,584,930 B2
(45) Date of Patent: Sep. 8, 2009

(54) ANTI-PILFER HOOK

(75) Inventor: Jerrold R. Zich, Bull Valley, IL (US)

(73) Assignee: Colony Incorporated, Elgin, IL (US)

( * ) Notice: Subject to any disclaimer, the term of this patent is extended or adjusted under 35 U.S.C. 154(b) by 295 days.

(21) Appl. No.: 11/436,301

(22) Filed: May 18, 2006

(65) Prior Publication Data

US 2007/0267557 A1 Nov. 22, 2007

(51) Int. Cl.
*A47B 96/06* (2006.01)

(52) U.S. Cl. ..... 248/220.31; 40/642.01; 211/57.1; 211/59.1

(58) Field of Classification Search ..... 211/57.1, 211/59.1, 7, 4
See application file for complete search history.

(56) References Cited

U.S. PATENT DOCUMENTS 4,303,217 A * 12/1981 Garfinkle ..... 248/220.42
4,616,753 A * 10/1986 Aslan ..... 211/57.1
5,235,766 A * 8/1993 Fast et al. ..... 40/642.01
6,003,685 A * 12/1999 Malin ..... 211/7
6,622,979 B2 * 9/2003 Valiulis ..... 248/220.42
D490,695 S * 6/2004 DeBiasio, Jr. ..... D8/373
6,811,128 B1 * 11/2004 Wagner et al. ..... 248/220.31
2005/0029205 A1 * 2/2005 Mansfield et al. ..... 211/7

* cited by examiner

*Primary Examiner*—Gwendolyn Baxter
(74) *Attorney, Agent, or Firm*—Olson & Cepuritis, Ltd.

(57) ABSTRACT

A hook is provided for display and dispensing of commercial articles, such as articles carried on a card or other backing member. The hook includes a first arm with a hook-shaped end and an adjacent bend portion. A second arm has an end spaced from the hook-shaped end and the bend portion whereby an article must be slid along the first arm, between gaps formed between the end of the second arm, the bend portion and the hook-shaped end, for removal and subsequent checkout. In one embodiment, the hook includes a mounting plate with ears for engaging a pegboard support and a hole for receiving a push fastener which engages the pegboard support. In another embodiment, the hook includes a mounting member for mounting to a crossbar support in which a pair of spaced apart wings are provided at one end of a mounting body and a pair of spaced apart end portions are provided at the other end of the mounting body. A resilient locking finger extends between the end portions for locking engagement with the crossbar support.

4 Claims, 5 Drawing Sheets

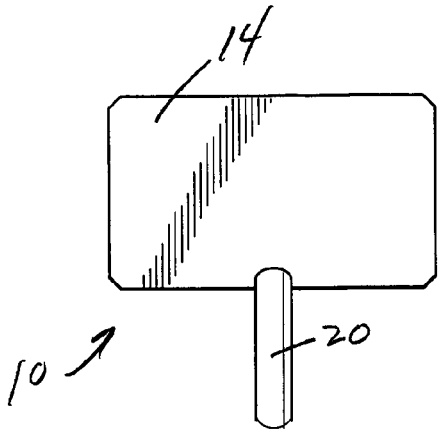
Fig. 4
Fig. 5
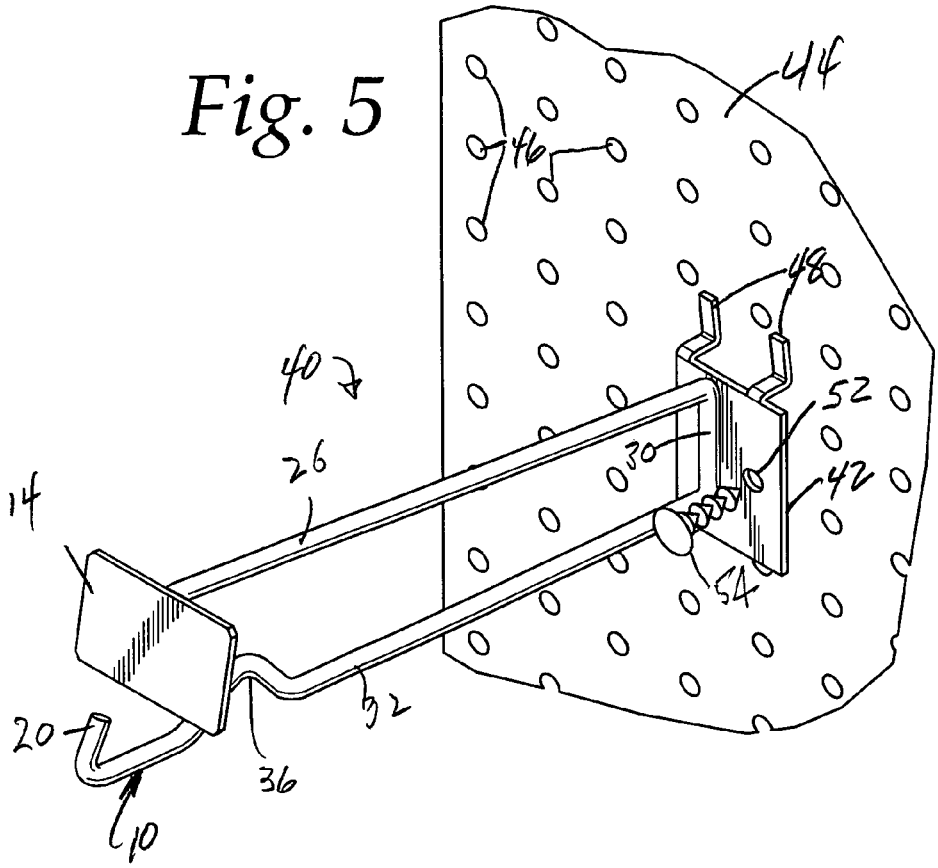

ANTI-PILFER HOOK

FIELD OF THE INVENTION

The present invention relates to arrangements for displaying and dispensing merchandise.

BACKGROUND OF THE INVENTION

A wide variety of merchandise is displayed and dispensed using support hooks which protrude from a mounting surface, so as to extend toward a customer. Frequently, the merchandise is carried on a card or backing member which has a hole at an edge portion for threading along the hook. Often times, the hooks are elongated so as to accommodate a plurality of articles. At times, an array of hooks is presented to a customer, each hook containing a plurality of like articles. The customer can quickly scan the articles arranged on the hooks and, upon locating a desired item, can slide the article off the hook for checkout. Unfortunately, an alarming number of instances have been reported in which the hook, and often times its entire contents, are removed from the mounting surface, presumably for unauthorized removal from the premises. A need has therefore arisen to prevent such unauthorized removal of hooks and related display and dispensing structures.

SUMMARY OF THE INVENTION

The present invention provides a novel and improved hook and hook mounting system that minimizes the disadvantages associated with prior art display and dispensing equipment. One embodiment of the hook assembly comprises a first arm having a hook-shaped end adjacent to a bend portion. A second arm has an end located between the bend portion and the hook-shaped end so as to form first and second gaps therewith. An article must be slid along the first arm, through the first and second gaps, for removal and subsequent checkout.

In another embodiment, the hook assembly is provided with a mounting member joined to the first and the second arms and including a mounting plate defining a fastening hole to receive a fastener for securing the mounting member to a support structure. In a further embodiment, the mounting member includes a pair of mounting legs extending from the mounting plate, to engage the support structure. In a further arrangement, the mounting legs are spaced by a spacing distance equal to the distance between one of the mounting legs and a fastening hole, so as to accommodate support structures such as pegboard having a rectilinear array of holes.

In another embodiment, a mounting member is provided for mounting the hook assembly to a crossbar support. Included is a mounting clip having a body with opposed ends and a pair of spaced apart wings at one end of the body. A pair of spaced apart end portions are located at the other end of the body and a resilient locking finger is disposed between and extending generally beyond the end portions. A free end of the locking finger is spaced from the body so as to form a gap for receiving a support structure, locking the mounting clip to the support structure. In one example the resilient locking finger is integrally formed with a mounting member and in another example the resilient locking finger is formed with a plate member made of spring steel or other resilient material. The plate member is joined to the mounting clip, and is held between the end portions and the mounting clip body.

BRIEF DESCRIPTION OF THE DRAWINGS

In the drawings,

FIG. 4 is an end view thereof;

FIG. 5 is a perspective view of a hook and mounting assembly shown in conjunction with a support surface;

DESCRIPTION OF THE PREFERRED EMBODIMENTS

Figure 1:
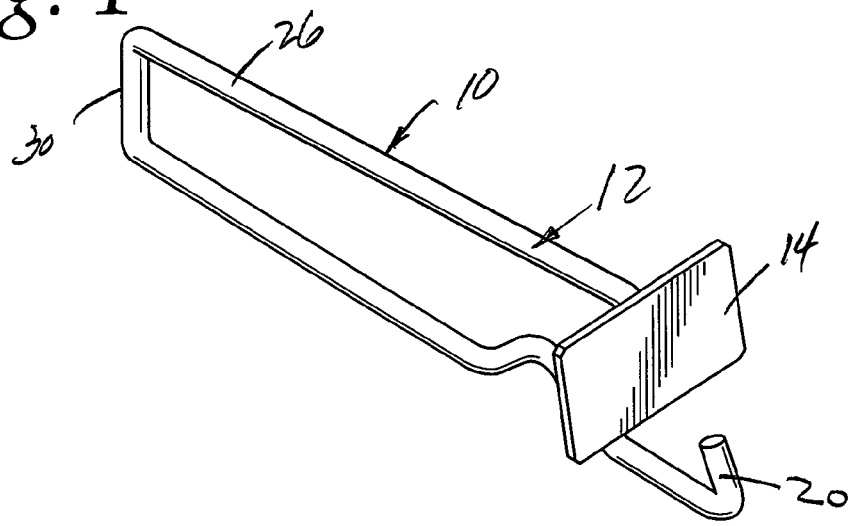
FIG. 1 is a perspective view of a hook according to principles of the present invention.

The invention disclosed herein is, of course, susceptible of embodiment in many different forms. Shown in the drawings and described herein below in detail are preferred embodiments of the invention. It is understood, however, that the present disclosure is an exemplification of the principles of the invention and does not limit the invention to the illustrated embodiments. For ease of description, a hook and hook mounting apparatus is described herein below in its usual assembled position as shown in the accompanying drawings, and terms such as upper, lower, horizontal, longitudinal, etc., may be used herein with reference to this usual position. However, the hook and hook mounting apparatus may be manufactured, transported, sold, or used in orientations other than that described and shown herein.

Referring to FIGS. 1-4, a hook generally indicated at 10 is provided for displaying and dispensing articles, such as articles of merchandise. Hook 10 includes a body 12, preferably of monolithic unitary construction, and a backing plate 14. Body 12 is preferably made from rigid material such as metal wire of steel or the like, but may also be molded or otherwise formed from plastic or other suitable material. Plate 14, in the preferred embodiment, provides a convenient support surface for labels, price tags, advertising indicia, or the like. Plate 14 is a preferably rigidly secured with respect to hook 10 so as to prevent deflection with respect to end 20, requiring a customer to carefully negotiate the upturned bend and upturned end 20 when removing an object from the hook.

Figure 2:
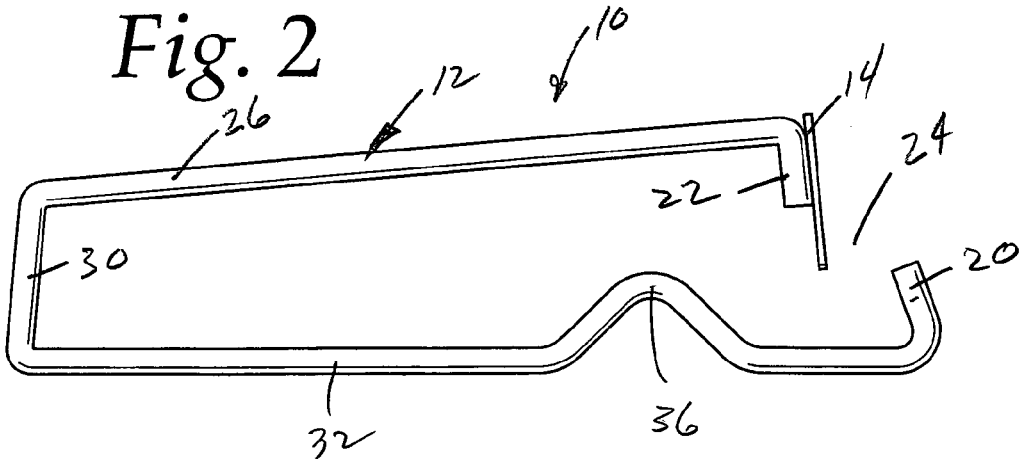
FIG. 2 is a side elevational view thereof.
Figure 3:
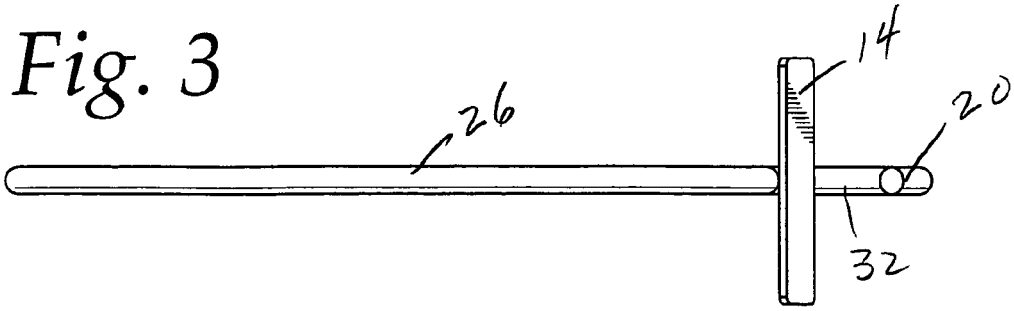
FIG. 3 is a top plan view thereof.
Figure 6:
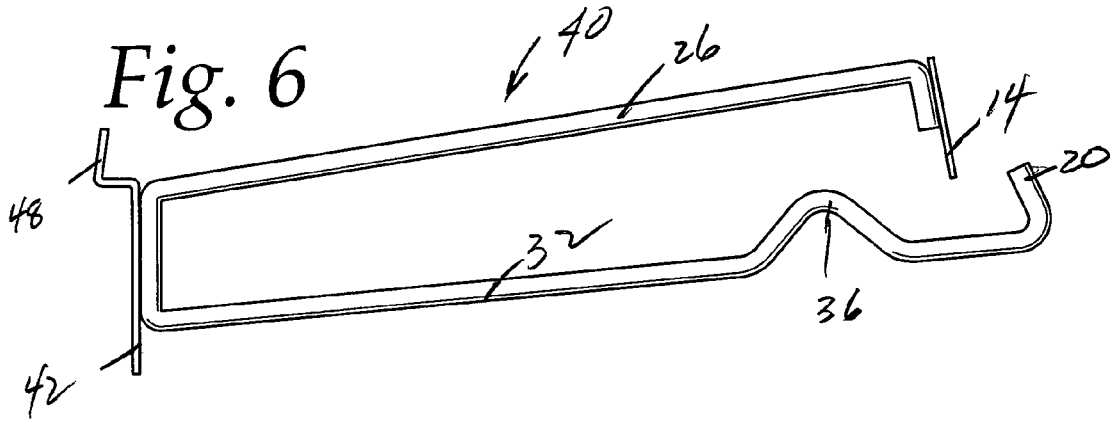
FIG. 6 is a side elevational view thereof.

With reference to FIG. 2, body 12 has first and second opposed free ends 20, 22 both of which are bent so as to extend generally in a direction toward one another. However, as can be seen in FIG. 2, the ends 20, 22 are offset from one another and are spaced apart by a gap 24. End 22 is carried by an upper arm 26 which extends from the front of hook 10 to a back portion 30. A lower arm 32 extends from back portion 30 to end 20. An upturned bend 36 is formed in lower arm 32, adjacent end 20. In the preferred embodiment, the upturned bend 36 has a rounded V-shape, and extends in an upward direction toward upper arm 26. As can be seen for example in FIG. 2, upturned bend 36 also generally extends toward gap 24. Backing plate 14 is joined to end 22 by welding or other suitable joining technique. If desired, backing plate 14 can be provided with a collar or similar feature for joinder with end 22 and/or upper arm 26. As can be seen in FIG. 2, for example, backing plate 14 preferably extends into gap 24 formed between ends 20, 22, and backing plate 14 is dimensioned such that its bottom edge is located above arm 32 at a point corresponding generally to the top of upturned bend 36. Further, as can be seen in FIG. 2, the upper extent of end 20, the bottom of support plate and the top of upturned bend 36 are aligned generally along a common horizontal line that is, a line extending generally along the direction of length of top and bottom arms 26, 32.

Referring now to FIG. 5, an assembly 40 includes hook 10 and mounting plate 42 which provides mounting for hook 10 to mounting surface 44 illustrated herein as a sheet of pegboard material in which is formed an array of holes 46. Mounting plate 42 in the illustrated embodiment, has a pair of offset or L-shaped legs 48 dimensioned for entry into holes 46 to allow engagement with mounting surface 44. Mounting plate 42 further includes a hole 52 positioned for alignment with one of the holes 46. A one-way fastener 54 is inserted through holes 52, 46 so as to engage mounting surface 44. Fastener 54 is illustrated in the preferred embodiment as being formed from plastic material so as to have a series of deformable teeth which engage mounting surface 44 so as to prevent extraction of fastener 54. Other conventional fastening means could also be employed, such as rivets, screws and the like fasteners. Preferably, the fastener employed has a "push-to-lock" action so as to readily lock hook 10 to mounting surface 44.

Figure 7:
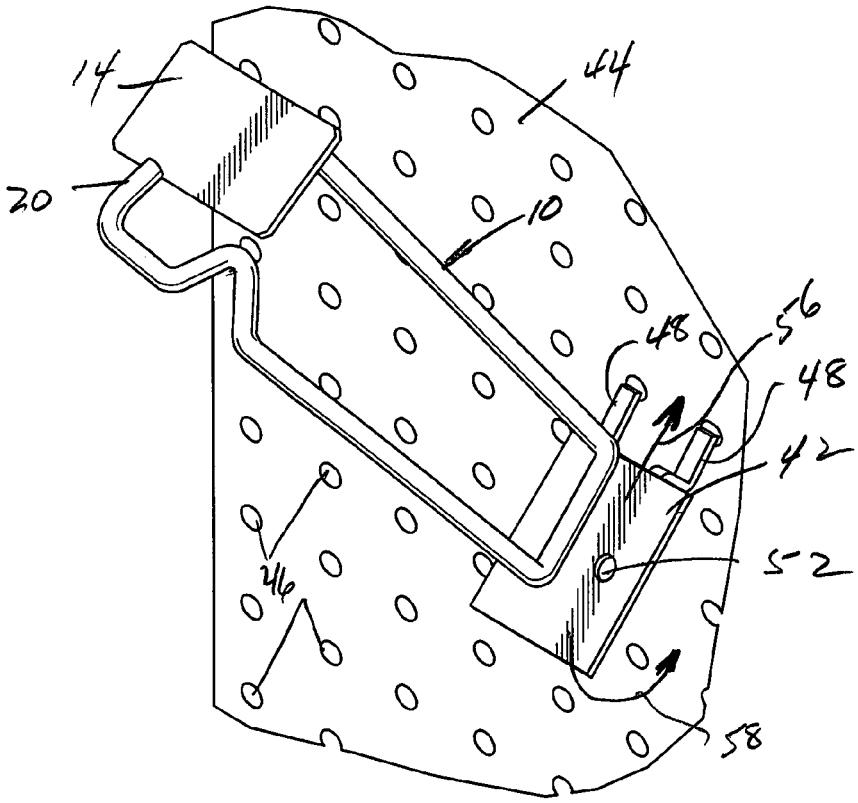
FIG. 7 is a perspective view showing installation of the hook and mounting system in the support surface.

As indicated in FIG. 7, legs 48 are inserted into holes 46 in the direction of arrow 56 and mounting plate 42 is then rotated in the direction of arrow 58 which brings the backing plate into contact with mounting surface 44, with hole 52 aligned with one of the holes 46 of the backing plate.

Figure 12:
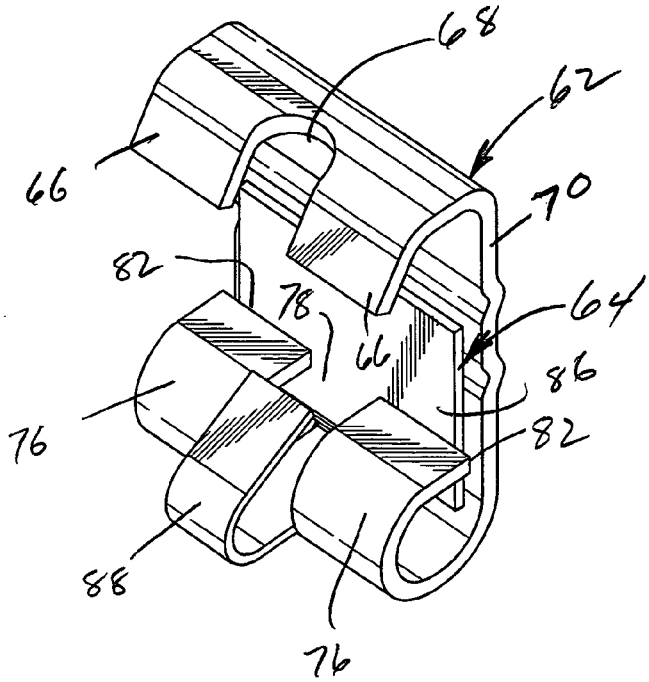
FIG. 12 is a perspective of a hook mounting member.

Referring now to FIGS. 8-12, a hook assembly is generally indicated at 60. Included is hook 10, mounting clip 62 and locking clip 64. Mounting clip 62 can be provided for use with a crossbar support employing either a channel or an openwork wire construction. With reference to FIG. 12. mounting clip 62 is preferably formed from a monolithic sheet of rigid material such as steel or other metal. Alternatively, mounting clip 62 can be molded from plastic or other suitable material. Mounting clip 62 includes a pair of upper wings 66 separated by a gap 68. Upper wings 66 extend from body portion 70 and are formed in a hook shape so as to receive a conventional cross bar support. Slot 68 accommodates cross bar supports formed of wire material and which extend transversely to a supporting member received in gap 68. As can be seen in FIG. 12, mounting clip 62 includes a pair of end portions 76 at its lower end separated by a gap 78. End portion 76 are preferably rolled, or curled so as to bring their free ends 82 immediately adjacent back 70.

Figure 8:
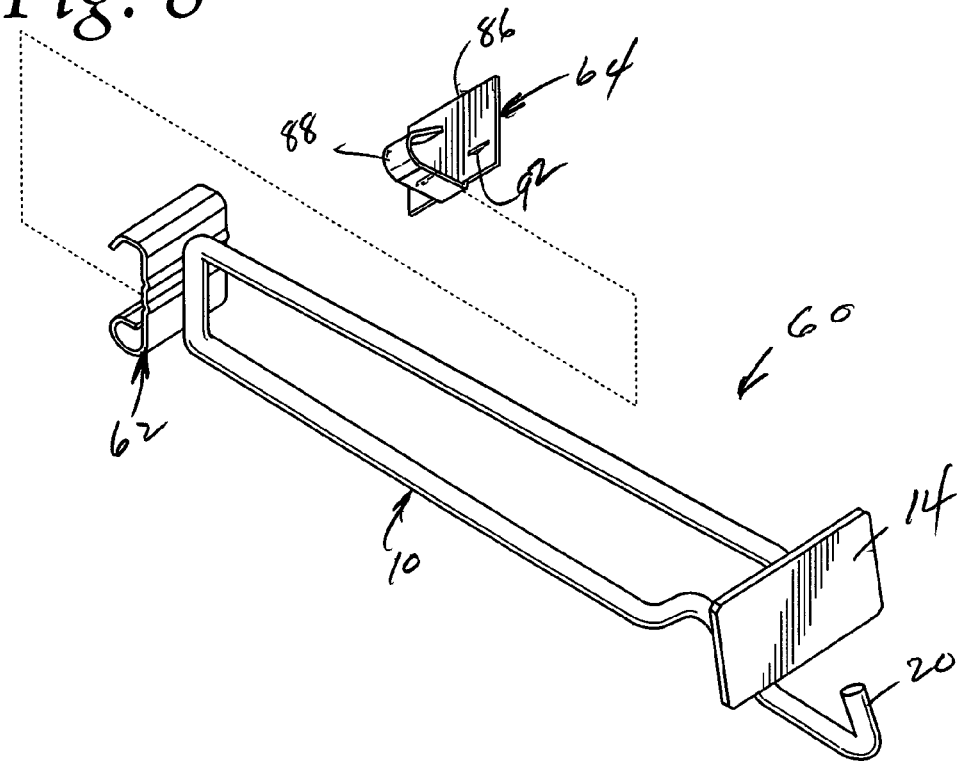
FIG. 8 is an exploded perspective view of a hook and hook mounting system.

With reference to FIGS. 8 and 12, locking clip 64 includes a body portion 86 and a locking finger 88 preferably formed with a reverse bend so as to have a free end adjacent body portion 86. A pair of outwardly protruding bosses 92 are formed in body portion 86 so as to extend toward locking finger 88. As can be seen in FIG. 12, locking clip 64 is inserted within mounting clip 62 with its body portion 86 located against body portion 70 of mounting clip 62. As can be seen in FIG. 12, locking finger 88 extends through gap 78 with the free end of the locking clip located adjacent the free ends of lower clip portions 76. Locking clip 64 is preferably made of a material which imparts a resilience to locking finger 88. Locking clip 64 may be formed, for example, from spring steel but may also be molded from a suitable plastic material. Bosses 92 of locking clip 64 interfere with the free ends 82 of lower clip portions 76 so as to retain the locking clip in desired position with respect to mounting clip 62.

Figure 9:
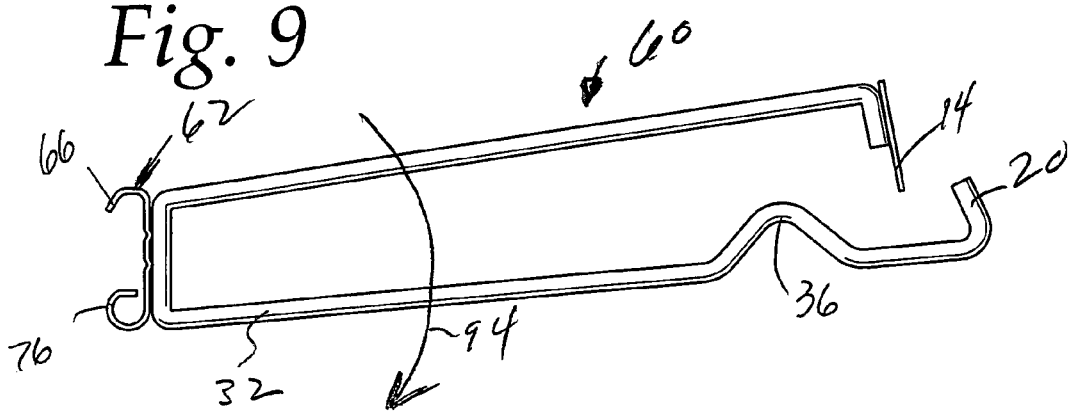
FIG. 9 is a side elevational view thereof.
Figure 10:
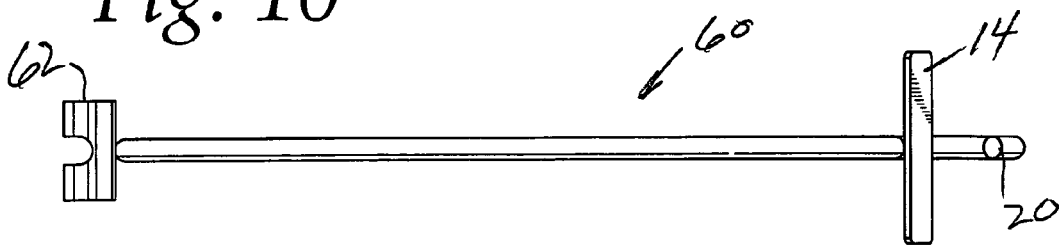
FIG. 10 is a top plan view thereof.
Figure 11:
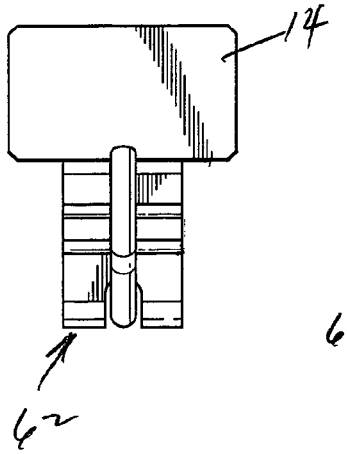
FIG. 11 is an end view thereof.

Referring to FIG. 9, in the preferred embodiment, hook assembly 70 is mounted to a support member (not shown) by engaging an upper edge of a support member with hook-shaped wings 66. The hook assembly is then rotated in the direction of arrow 94 so as to bring lower clip portions 76 into engagement with a bottom edge of the support. With additional reference to FIG. 12, as a hook assembly is rotated in the direction of arrow 94 the free end of spring finger 88 is deflected by the bottom edge of the support member and when the hook assembly is fully seated, the free end of spring finger 88 engages the bottom portion of support, preventing disengagement.

As can be seen from FIGS. 2 and 9, the bend portion 36 and the end 22 define a first gap and the hook-shaped end 20 and the end 22 define a second gap. Articles supported on the hook must be slid along arm 32 and past bend 36 so as to pass through the first and the second gaps, for removal and subsequent checkout. Plate 14 is located generally midway between end 20 and upturned bend 36. Also, the bottom of plate 14 is located generally equally distant from end 20 and that portion of bottom arm 32 located immediately adjacent plate 14. In the preferred embodiment, this distance is set slightly greater than that portion of the card support between the upper edge of the card and the "hang" hole formed in the card to allow the card to be slid along bottom arm 32. This arrangement allows secure retention of the carded object on the hook and requires the user to exercise some degree of care in removing a carded object from the hook.

The foregoing description and the accompanying drawings are illustrative of the present invention. Still other variations and arrangements of parts are possible without departing from the spirit and scope of this invention.

I claim:

1. A mounting member including a mounting clip, for mounting a display hook to a crossbar support, the mounting clip comprising:

a body having opposed ends;

a pair of spaced apart wings at one end of the body;

a pair of spaced apart end portions at the other end of the body;

a resilient locking finger between and extending generally beyond the end portions and spaced from the body to form a gap for receiving a support structure, locking the mounting clip to the support structure; and a locking clip joined to the mounting clip and carrying the locking finger;

wherein the locking clip comprises a plate in contact with the mounting clip body between the mounting clip body and the end portions and wherein the locking clip includes at least one boss outstruck from the plate for engaging the end portions.

2. The mounting member of claim 1 wherein the locking finger is monolithically formed with the locking clip.

3. The mounting member of claim 1 wherein the locking finger and the locking clip are formed from a monolithic sheet of resilient material.

4. The mounting member of claim 1 wherein the locking finger is monolithically formed from the body.

* * * * *